US010914099B2

(12) United States Patent
Gentil

(10) Patent No.: US 10,914,099 B2
(45) Date of Patent: Feb. 9, 2021

(54) SECURITY GATE WITH GATE LOCK

(71) Applicant: Dorel Juvenile Group, Inc., Foxboro, MA (US)

(72) Inventor: Jean-Luc Gentil, Cholet (FR)

(73) Assignee: Dorel Juvenile Group, Inc., Foxboro, MA (US)

( * ) Notice: Subject to any disclaimer, the term of this patent is extended or adjusted under 35 U.S.C. 154(b) by 243 days.

(21) Appl. No.: 16/132,013

(22) Filed: Sep. 14, 2018

(65) Prior Publication Data

US 2019/0078353 A1 Mar. 14, 2019

Related U.S. Application Data

(60) Provisional application No. 62/558,539, filed on Sep. 14, 2017.

(51) Int. Cl.

| | |
|---|---|
| ***E05B 65/00*** | (2006.01) |
| ***E05C 1/12*** | (2006.01) |
| ***E06B 9/04*** | (2006.01) |
| ***E05F 1/06*** | (2006.01) |
| ***E05F 1/12*** | (2006.01) |
| ***E06B 11/02*** | (2006.01) |
| *E06B 9/00* | (2006.01) |

(52) U.S. Cl.

CPC ..... *E05B 65/0007* (2013.01); *E05B 65/0014* (2013.01); *E05C 1/12* (2013.01); *E05F 1/066* (2013.01); *E05F 1/1223* (2013.01); *E06B 9/04* (2013.01); *E06B 11/022* (2013.01); *E05Y 2900/40* (2013.01); *E06B 2009/002* (2013.01)

(58) Field of Classification Search

None

See application file for complete search history.

(56) References Cited

U.S. PATENT DOCUMENTS

| | | | | |
|---|---|---|---|---|
| 6,032,987 | A | 3/2000 | Fukumoto et al. | |
| 6,969,108 | B2 | 11/2005 | Fukumoto et al. | |
| 6,986,354 | B1 | 1/2006 | Burns | |
| 7,588,271 | B1 | 9/2009 | Lawrence | |
| 8,388,030 | B2 | 3/2013 | Takahashi et al. | |
| 8,448,381 | B2 | 5/2013 | Flannery | |
| 8,733,017 | B2 | 5/2014 | Marsden et al. | |
| 8,789,861 | B2 | 7/2014 | Takayanagi et al. | |
| 9,279,284 | B1 * | 3/2016 | Axelrod | E05B 65/0014 |
| 9,458,668 | B1 * | 10/2016 | Flannery | E06B 7/32 |
| 9,637,959 | B2 | 5/2017 | Marsden et al. | |
| 9,689,197 | B1 * | 6/2017 | Flannery | E06B 7/32 |
| 10,113,335 | B1 * | 10/2018 | Flannery | E06B 7/32 |

(Continued)

FOREIGN PATENT DOCUMENTS

| | | | | |
|---|---|---|---|---|
| GB | 2271144 A | * | 4/1994 | E05B 65/0007 |

*Primary Examiner* — Marcus Menezes

(74) *Attorney, Agent, or Firm* — Barnes & Thornburg LLP

(57) ABSTRACT

A gate unit includes a gate mount that is adapted to mate with a frame bordering a passageway and formed to include a latch receiver and a gate mounted on the gate mount for pivotable movement about a gate-pivot axis between an opened position opening a walkway passage formed in the gate mount and a closed position closing the walkway passage formed in the gate mount. The gate unit further includes a gate lock configured to lock the gate in the closed position closing the walkway passage formed in the gate mount.

17 Claims, 8 Drawing Sheets

(56) References Cited

U.S. PATENT DOCUMENTS

| | | | | |
|---|---|---|---|---|
| 2003/0009945 | A1* | 1/2003 | Cheng | E05F 1/1223 49/57 |
| 2005/0072086 | A1* | 4/2005 | Lim | E05B 65/0014 52/455 |
| 2007/0074453 | A1* | 4/2007 | Flannery | E06B 7/32 49/57 |
| 2008/0185566 | A1* | 8/2008 | Flannery | E06B 9/06 256/73 |
| 2008/0284180 | A1* | 11/2008 | Newcombe | E06B 9/04 292/198 |
| 2012/0055092 | A1 | 3/2012 | Boucquey et al. | |
| 2013/0160365 | A1* | 6/2013 | Flannery | E05C 1/10 49/50 |
| 2017/0058594 | A1 | 3/2017 | Marsden | |
| 2017/0211314 | A1 | 7/2017 | Raffi et al. | |

* cited by examiner

SECURITY GATE WITH GATE LOCK

PRIORITY CLAIM

This application claims priority under 35 U.S.C. § 119(e) to U.S. Provisional Application No. 62/558,539 filed Sep. 14, 2017, which is expressly incorporated by reference herein.

BACKGROUND

The present disclosure relates to movable barriers. More particularly, the present disclosure relates to juvenile gates for inside a dwelling.

SUMMARY

A gate unit in accordance with the present disclosure includes a gate that can be moved about a vertical gate-pivot axis by a person between OPENED and CLOSED positions. In illustrative embodiments, the gate unit also includes a slidable latch that is movable relative to the gate to retain the gate in the CLOSED position and establish a LOCKED mode of the gate.

In illustrative embodiments, the gate unit also includes a gate mount that is adapted to mate with a frame bordering a passageway such as a door frame bordering a doorway or a wall bordering a hallway. The gate is mounted on upper and lower hinges included in the gate mount for pivotable movement about a vertical gate-pivot axis between a CLOSED position closing a walkway passage formed in the gate mount to block movement of a person through the walkway passage and an OPENED position opening the walkway passage. The latch is carried on the pivotable gate and arranged to engage a latch receiver provided in the gate mount to lock the gate in the CLOSED position and to disengage the latch receiver to free the gate to be pivoted about the gate-pivot axis to an OPENED position.

In illustrative embodiments, the latch is included in a gate lock of the gate unit. The gate lock is coupled to the gate and configured to mate with the gate mount to retain the gate in the CLOSED position. The gate lock is configured to be activated by a gate operator using a two-step SLIDE-BACK/LIFT-UP gate-unlocking process in accordance with the present disclosure to unlock the gate so that it can be pivoted by the gate operator from the CLOSED position to the OPENED position.

In illustrative embodiments, the gate lock also includes a latch actuator that is configured to provide means for establishing a two-step SLIDE-BACK/LIFT-UP gate-unlocking process in accordance with the present disclosure. In this process, a LIFT-UP step is carried out by a gate operator to move the slidable latch from the EXTENDED position the RETRACTED position to free the gate to be pivoted to the OPENED position after a SLIDE-BACK step has been carried out by the gate opener to activate the mechanism that is used to in the LIFT-UP Step.

In illustrative embodiments, the latch actuator comprises a slidable latch release that is first used by the gate operator in the SLIDE-BACK step and a pivotable latch retractor that is then used by the gate operator in the subsequent LIFT-UP step to move the latch of the gate-pivot blocker from the EXTENDED position to the RETRACTED position to disengage the latch receiver formed in the gate mount so as to free the gate to be pivoted to an OPENED position by the gate operator. The slidable latch release is mounted for sliding movement on and relative to the pivotable latch retractor between a FORWARD PIVOT-BLOCKING position and a REARWARD RETRACTOR-RELEASING position. The pivotable latch retractor is mounted for pivotable movement on the gate about a retractor-pivot axis between a LOWERED position and a PIVOTED position. The slidable latch release is carried on the pivotable latch retractor so that it will also be pivoted about the retractor-pivot as during pivotable movement of the pivotable latch retractor.

In illustrative embodiments, the pivotable latch retractor can be pivoted about the retractor-pivot axis by a gate operator to complete a LIFT-UP step of the two-step SLIDE-BACK/LIFT-UP gate-unlocking process disclosed herein. The pivotable latch retractor includes first pin-guide means for moving a latch-retractor pin coupled to the slidable latch away from the latch receiver formed in the gate mount to cause the slidable latch to move to the RETRACTED position in response to upward pivoting movement of the pivotable latch retractor relative to the top rail about the retractor-pivot axis under the manual control of a gate operator that has gripped and pivoted the pivotable latch retractor during the LIFT-UP step. A slanted slot formed in the pivotable latch retractor to receive the latch-retractor pin for back-and-forth sliding movement therein provides the pin-guide means in an illustrative embodiment of the present disclosure.

In illustrative embodiments, the slidable retractor release that is mounted for back-and-forth slidable movement on the pivotable latch retractor functions normally to anchor and thereby disable the pivotable latch retractor so that is cannot be pivoted about the retractor-pivot axis to retract the latch until a gate operator first completes a SLIDE-BACK step of the TWO-STEP/SLIDE-BACK lift-up gate-unlocking process. The slidable retractor release is coupled to the pivotable latch retractor to pivot therewith about the horizontal retractor-pivot axis. The slidable retractor release is mounted for sliding movement on the pivotable latch retractor during the SLIDE-BACK step between (1) a normal FORWARD PIVOT-BLOCKING position in which the slidable retractor release engages the latch-retractor pin to block sliding movement of the slidable latch relative to the top rail of the gate from the EXTENDED position to the RETRACTED position so that the gate cannot be pivoted by the gate operator about the vertical gate-pivot axis from the CLOSED position to the OPENED position and (2) a temporary REARWARD RETRACTOR-RELEASING position in which the slidable retractor release disengages the latch-retractor pin to allow the latch-retractor pin to be moved by the pin-guide means of the pivotable latch retractor away from the latch receiver gate mount during upward pivoting movement of the pivotable latch retractor about the retractor-pivot axis to cause the slidable latch to move rearwardly on the gate from the EXTENDED position to the RETRACTED position so that the gate can be pivoted by a gate operator about the gate-pivot axis from the CLOSED position to an OPENED position.

In an illustrative process in accordance with the present disclosure, in a first gate-unlocking SLIDE-BACK step, a gate operator grips and slides the slidable retractor release back on the pivotable latch retractor from FORWARD PIVOT-BLOCKING position to the REARWARD RETRACTOR-RELEASING position to free the pivotable latch retractor to be pivoted about the retractor-pivot axis. In a subsequent second gate-unlocking LIFT-UP step, the gate operator grips and pulls upwardly on the slidable retractor release while the slidable retractor release remains in the REARWARD RETRACTOR-RELEASING position on the pivotable latch retractor to pivot the now-free-to-pivot pivotable latch retractor upwardly about the retractor-pivot axis to cause the latch-retractor pin that is linked to the pivotable latch retractor via the pin-guide means to be moved away from the latch receiver formed in the gate mount so that the slidable latch is moved relative to the top rail of the gate from the EXTENDED position to the RETRACTED position to disengage the latch receiver provided in the gate mount. Since the slidable latch on the gate has now disengaged the latch receiver provided in the gate mount following the completion of the two-step gate-unlocking SLIDE-BACK/LIFT-UP process in accordance with the present disclosure, the gate is free to be pivoted by a gate operator about the gate-pivot axis from the CLOSED position to an OPENED position.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying Figs. in which.

Figure 4:
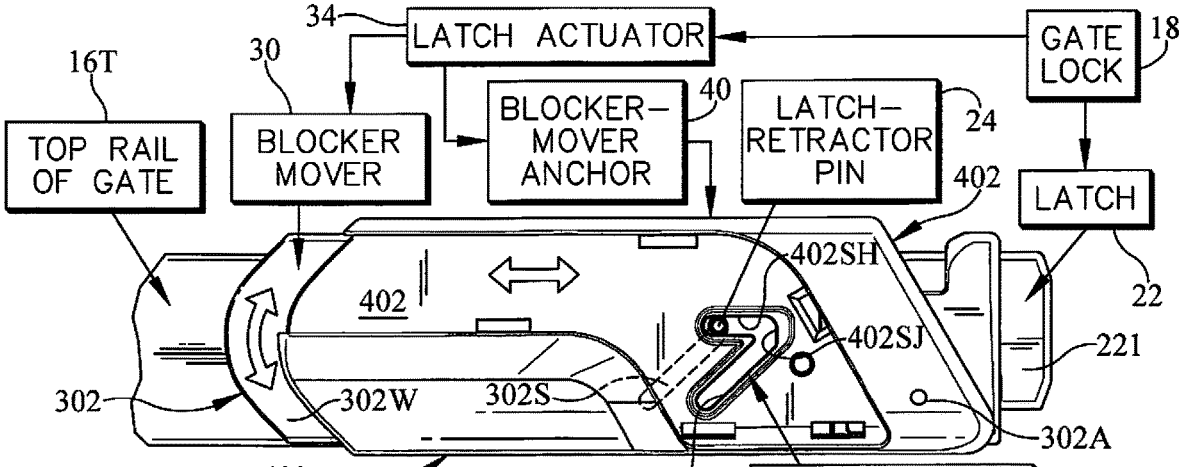
FIG. 4 an enlarged side elevation view of the gate lock of FIGS. 1 and 2 mounted on the top rail of the gate and showing the slidable latch in the EXTENDED position to cause the lock bolt to extend outwardly beyond the free end of the top rail of the gate and showing the latch actuator in a STAGE-ONE INACTIVE position in which a slidable retractor release included in the blocker-mover anchor is spring-biased by a spring interposed between the pivotable latch retractor and the slidable retractor release as suggested in FIG. 5 to move relative to the pivotable latch retractor of the blocker mover that is coupled for pivotable movement about the retractor-pivot axis relative to the top rail to a FORWARD PIVOT-BLOCKING position and showing that the slidable retractor release of the blocker-mover anchor is formed to include a 7-shaped pin-receiver slot comprising a horizontal slot segment and a positively sloping angled slot segment communicating with a right end of the horizontal slot segment at a segment junction between the slot segments and suggesting that the pivotable latch retractor is formed to include a positively sloping slanted slot (shown in phantom) that is not aligned with the positively sloping angled slot segment of the 7-shaped pin-receiver slot of the slidable retractor release.
Figure 5:
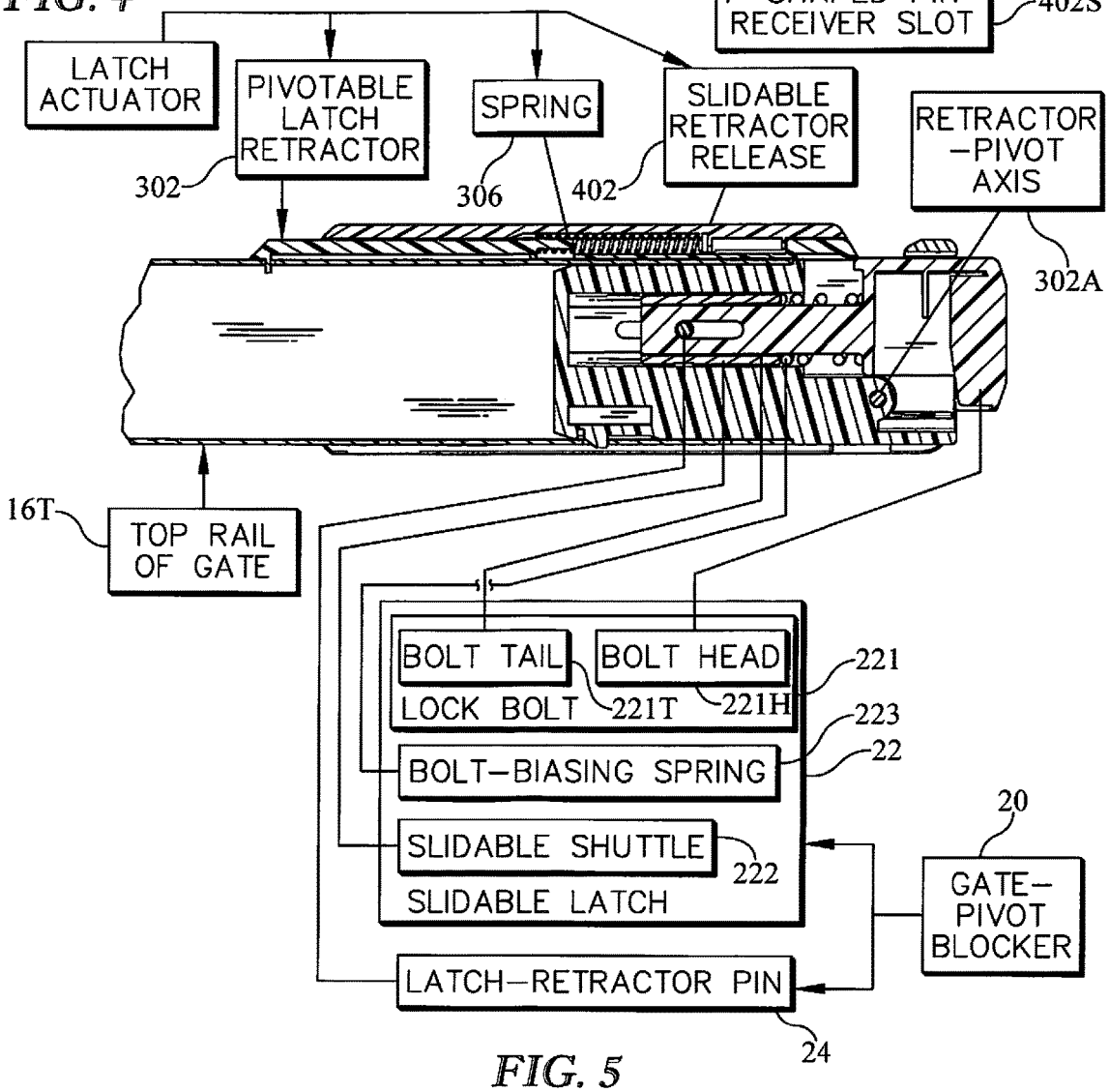
FIG. 5 is a sectional view taken along line 5-5 of FIG. 2 showing that the pivotable latch retractor of the latch actuator is mounted to the top rail of the gate for pivotable movement about the retractor-pivot axis and showing that the slidable latch comprises a lock bolt including a forwardly extending bolt head and a rearwardly extending bolt tail, a slidable shuttle mounted for back-and-forth sliding movement relative to the top rail in a shuttle-receiver channel formed in the top rail between a BOLT-EXTENDED position shown in FIGS. 4-8 and a BOLT-RETRACTED position shown in FIGS. 9 and 10, and a compressible bolt-biasing spring acting between and against the slidable shuttle and the bolt head of the lock bolt and winding around the bolt tail of the lock bolt, and showing that the latch-retractor pin is coupled to the slidable shuttle to move therewith and arranged to extend outwardly away from the slidable shuttle into a straight pin-receiver channel formed in the bolt tail of the lock bolt and into the 7-shaped pin-receiver slot formed in the slidable retractor release of the blocker-mover anchor of the latch actuator.
Figure 7:
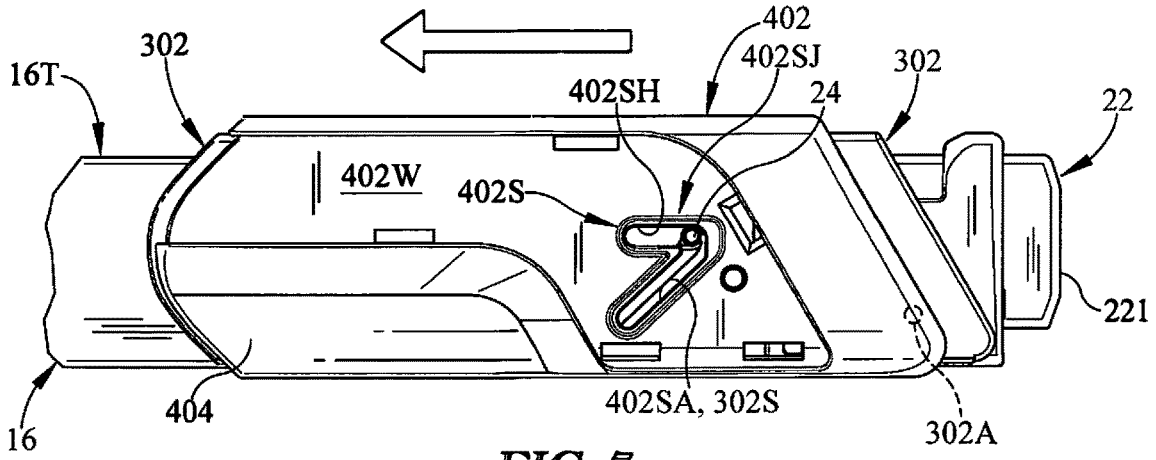
Figure 8:
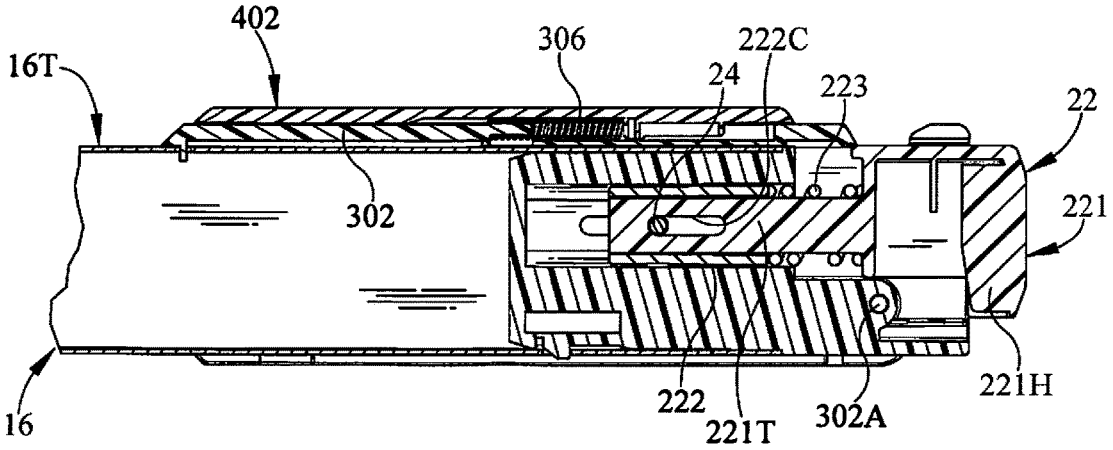
Figure 9:
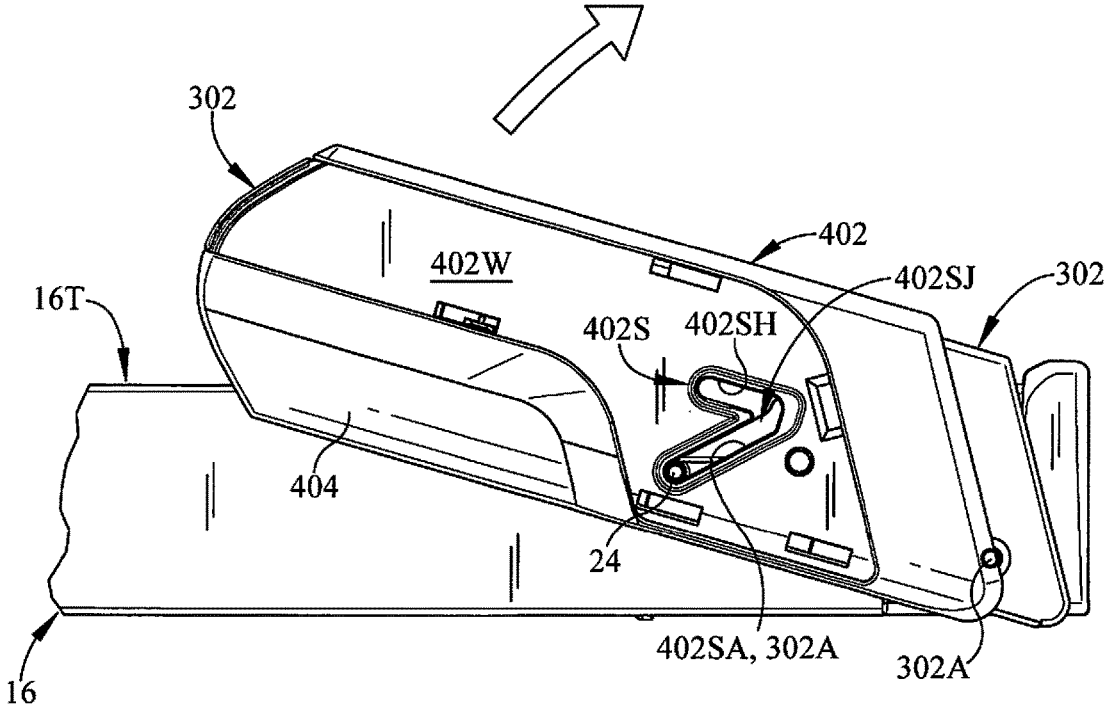
Figure 10:
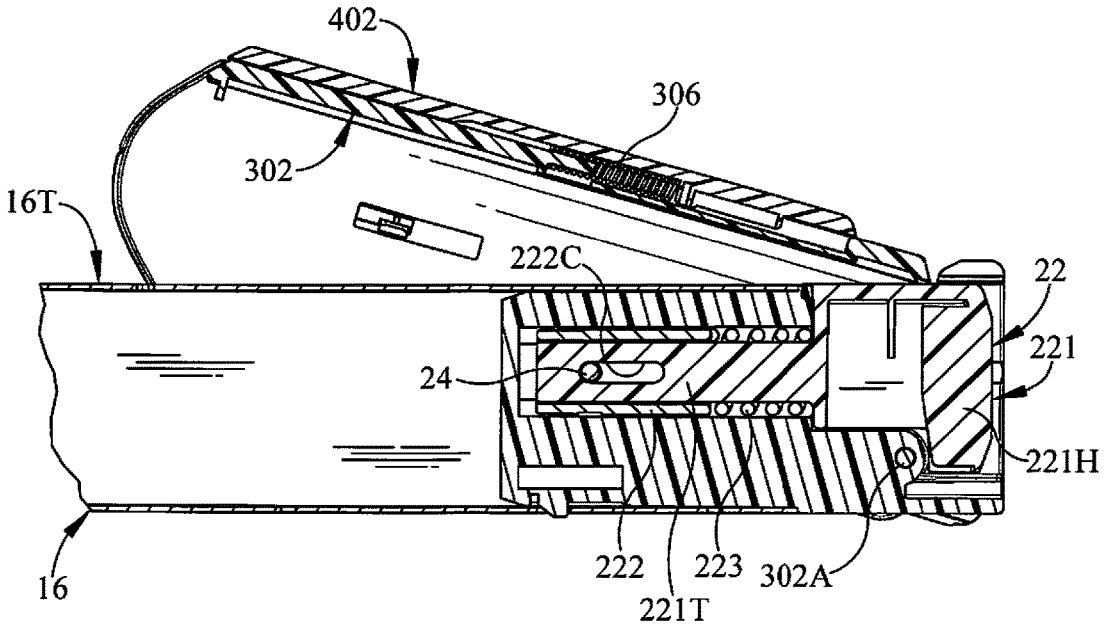

is blocked by engagement of latch-retractor pin included in the slidable gate-pivot blocker and an edge of the side wall of the slidable retractor release that borders the 7-shaped pin-receiver slot;

FIG. 7 is a side elevation view of the gate lock similar to FIG. 4 but showing the latch actuator in a STAGE-TWO INACTIVE position in with the slidable retractor release of the blocker-mover anchor has been moved to the left away from the free end of the top rail of the gate to compress a spring interposed between the pivotable latch retractor and the slidable retractor release and to cause relative movement between the slidable retractor release of the latch actuator and the slidable shuttle of the latch to cause the latch-retractor pin to move in the 7-shaped pin-receiver slot to a junction provided at the right end of the horizontal slot segment between the horizontal slot segment and the positively sloping angled slot segment so that the latch-retractor pin is now poised to enter and move downwardly in the positively sloping angled slot segment as shown in FIG. 9;

FIG. 8 is a sectional view similar to FIG. 5 showing the slidable retractor release in a REARWARD position on the pivotable latch retractor when the latch actuator is in the STAGE-TWO INACTIVE position;

FIG. 9 is a side elevation view similar to FIGS. 4 and 7 after the pivotable latch retractor has been pivoted in a clockwise direction about the retractor-pivot axis from a LOWERED position shown in FIGS. 4 and 7 to an UPWARDLY PIVOTED position because the latch-retractor pin coupled to the slidable shuttle was free to move in both of the positively sloping angled slot segment of the 7-shaped pin-receiver slot to a bottom end of the positively sloping angled slot segment and the aligned positively sloping slanted slot-formed in the pivotable latch retractor;

FIG. 10 is a sectional view similar to FIGS. 5 and 8 showing the pivotable latch retractor in the PIVOTED LATCH-RETRACTING position and showing that the slidable retractor release applied a rearwardly directed force to the latch-retractor pin to cause the slidable shuttle to move rearwardly in the top rail of the gate from the FORWARD PIVOT BLOCKING position shown in FIGS. 5 and 8 to the REARWARD RETRACTOR-RELEASING position shown in FIG. 10 to cause the slidable latch to move relative to the top rail of the gate from the EXTENDED POSITION shown in FIGS. 5 and 8 to the RETRACTED position shown in FIG. 10; and FIGS. 11-14 show additional views of a portion of the gate unit to illustrate proper use of the gate lock and proper and improper gate unit installation in a doorway.

DETAILED DESCRIPTION

Figure 1A:
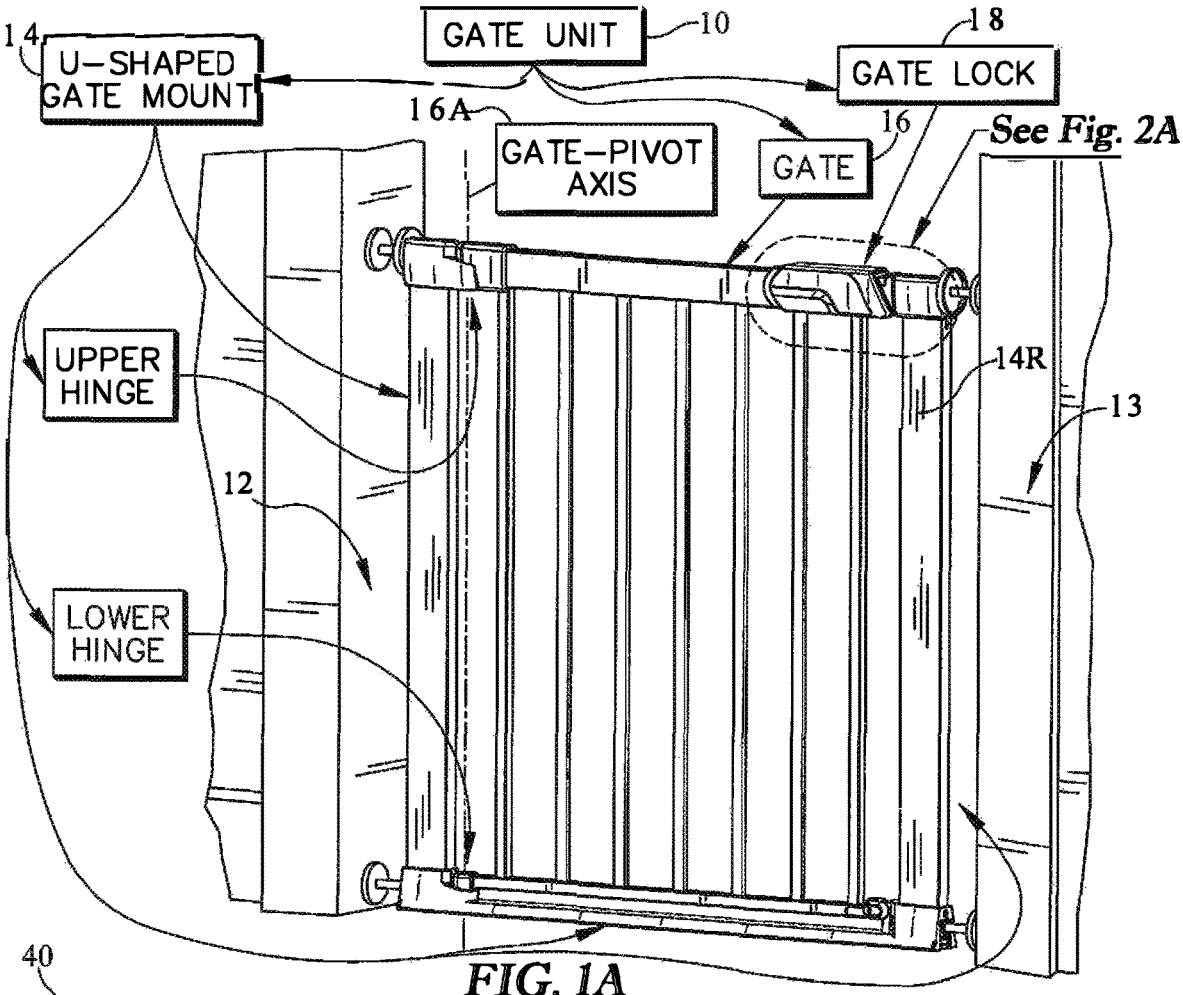
FIG. 1A is a front view of a gate unit in accordance with the present disclosure placed in a doorway and showing that the gate unit includes a U-shaped gate mount mating with a door frame bordering the doorway, a gate mounted on the gate mount for swinging movement about a vertical gate-pivot axis between CLOSED and OPENED positions, and a gate lock coupled to the gate and configured to mate with a right-side portion of the gate mount to lock the gate so as to retain the gate in the CLOSED position and to be actuated by an operator using a two-step SLIDE-BACK/LIFT-UP process in accordance with the present disclosure as suggested in FIGS. 1B and 2B and as shown in FIGS. 4, 7, and 9 to unlock the gate so that it can be pivoted from the CLOSED position to an OPENED position as shown in FIG. 2D.

A gate unit 10 in accordance with the present disclosure is place in a doorway 12 as suggested in FIG. 1. Gate unit 10 includes a U-shaped gate mount 14 mating with a door frame 13 bordering doorway 12 and a gate 16 mounted on gate mount 14 for swinging movement about a gate-pivot axis 16A between a CLOSED position shown in FIG. 1A and a CLOSED position shown in FIG. 2D.

Gate unit 10 also includes a gate lock 18 that is coupled to gate 16 to pivot therewith as suggested in FIGS. 2A-2D. Gate lock 18 is configured to mate with a right-side portion 14R of gate mount 14 as suggested in FIGS. 1 and 2A to lock gate 16 so as to retain gate 16 in the CLOSED position. Gate lock 18 is also configured to be actuated by a human gate operator 19 using a two-step SLIDE-BACK/LIST-UP gate-unlocking process in accordance with the present disclosure as suggested in FIGS. 1B and 2B and shown, for example, in FIGS. 4, 7, and 9 to unlock gate 16 so that gate 16 can be pivoted by the gate operator 19 from the CLOSED position shown in FIG. 1A to the OPENED position shown in FIG. 2D.

Figure 1B:
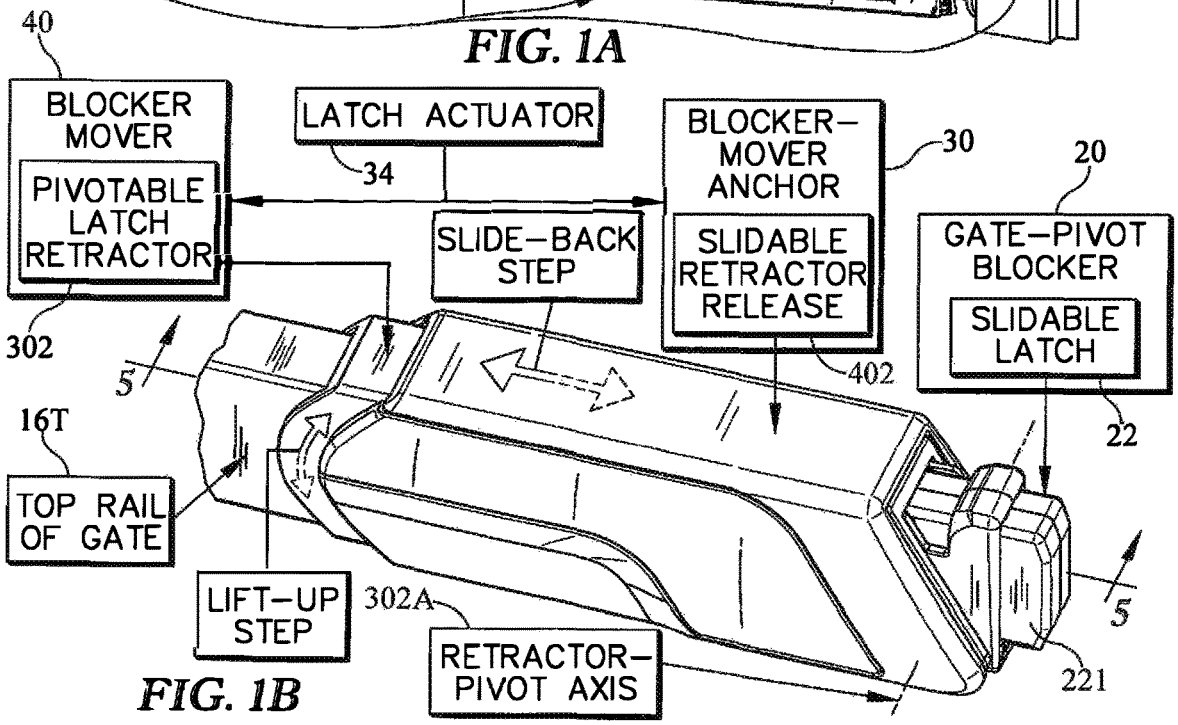
FIG. 1B is an enlarged perspective view of the gate lock of FIG. 1 showing that the gate lock includes a gate-pivot blocker comprising a slidable latch mounted for back-and-forth sliding movement in a top rail of the gate between an EXTENDED position extending beyond a free end of the top rail to block pivotable movement of the gate about the gate-pivot axis as suggested in FIG. 2A and a RETRACTED position lying inside the free end of the top rail as suggested in FIGS. 2B and 10 to free the gate to be pivoted from the CLOSED position to the OPENED position and a latch actuator that is used by a gate operator in accordance with a two-step gate-unlocking SLIDE-BACK/LIFT UP process disclosed herein to unlock the gate as suggested in FIGS. 2A-2D and shown in FIGS. 4, 7, and 9.
Figure 3:
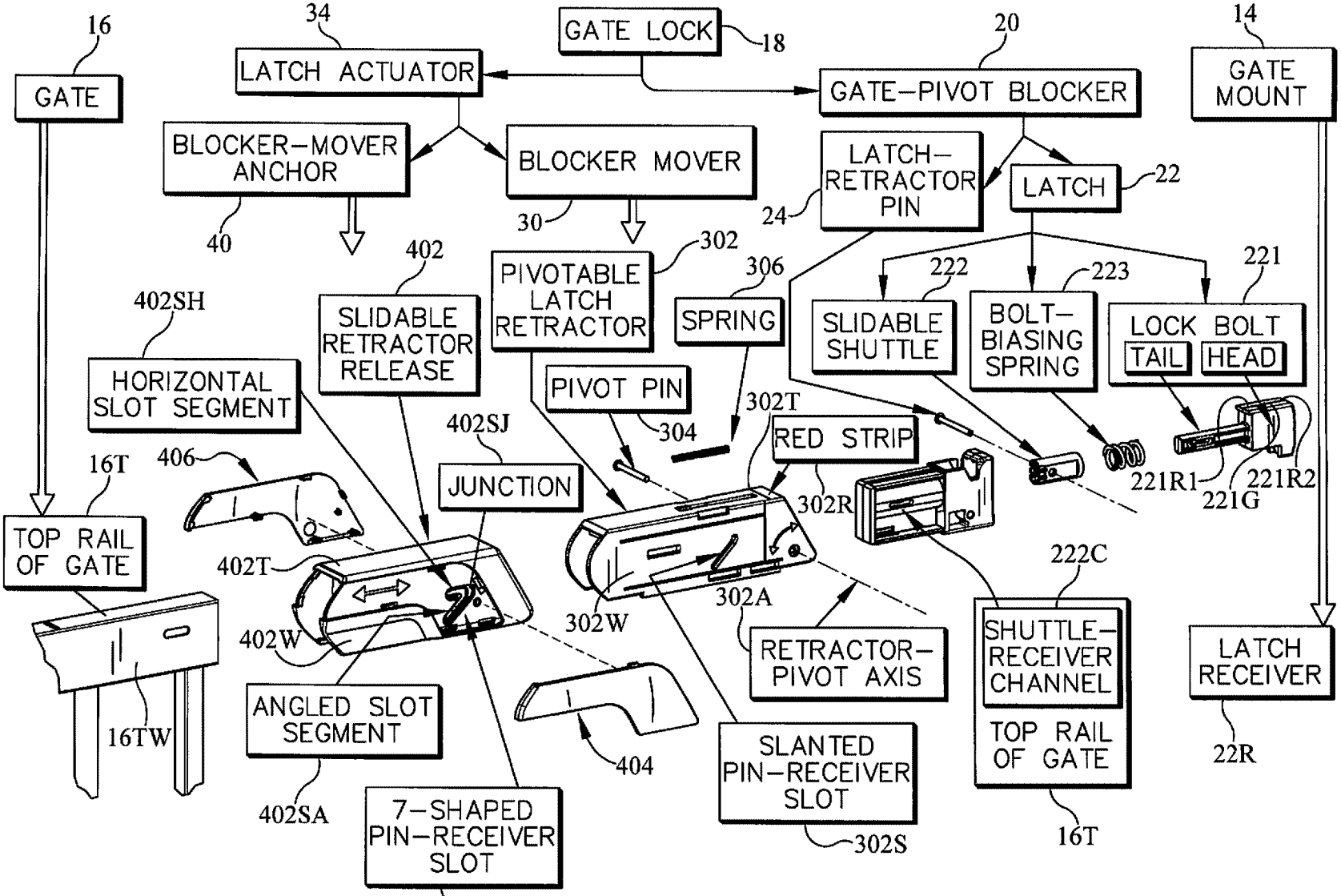
FIG. 3 is an exploded perspective assembly view showing components included in the gate lock and showing that the gate-pivot blocker includes a latch and a latch-retractor pin, the latch comprises a slidable shuttle coupled to the latch-retractor pin and adapted to slide back and forth in a shuttle-receiver channel formed in the top rail of the gate, a lock bolt sized to extend into a latch receiver formed in the gate mount when the gate occupies the CLOSED position, and a bolt-biasing spring for acting between the slidable shuttle and the lock bolt to yieldably urge the lock bolt away from the slidable shuttle to assure the EXTENDED position yet allow relative movement between the lock bolt and the slidable shuttle during latching of the gate and also showing components that are included in the blocker mover of the latch actuator and the blocker-mover anchor of the latch actuator.

As suggested in FIGS. 1B and 3, gate lock 18 includes a gate-pivot blocker 20, a blocker mover 30 that controls the functionality of gate-blocker mover 20, and a blocker-mover anchor 14 that controls the functionality of blocker mover 30. Gate-pivot blocker 20 includes a slidable latch 22 that is mounted for back-and-forth sliding movement on a top rail 16T of gate 16 to engage a latch receiver 22R formed in gate mount 14 to block pivoting movement of gate 16 about gate-pivot axis 16A and alternatively to disengage latch receiver 22R to free gate 16 to pivot about gate-pivot axis 16A between CLOSED and OPENED positions.

Blocker mover 30 includes a pivotable latch retractor 302 that (once released for pivotable movement using a SLIDE-BACK step described herein) can be pivoted upwardly by gate operator 19 about retractor-pivot axis 302A in a LIFT-UP step of the two-step SLIDE-BACK/LIFT-UP gate-unlocking process to cause slidable latch 22 to slide from an EXTENDED position engaging latch receiver 22R in gate mount 14 to a RETRACTED position disengaging latch receiver 22R in gate mount 14. Blocker-mover anchor 40 includes a slidable retractor release 402 that can be slid back on pivotable latch retractor 302 by gate operator 19 in a SLIDE-BACK step of the two-step SLIDE-BACK/LIFT-UP gate-unlocking process from a FORWARD PIVOT-BLOCKING position to a REARWARD RETRACTOR-RELEASE position. Blocker mover 30 and blocker-mover actuator 40 cooperate to define a latch actuator 34 that can be hand-operated by a gate operator 19 to withdraw latch 22 of gate lock 18 from latch receiver 22R of gate mount 14 using the two-step SLIDE-BACK/LIFT-UP gate-unlocking process disclosed herein to free gate 16 to be pivoted about gate-pivot axis 16A from a CLOSED position shown in FIG. 1A to an OPENED position shown in FIG. 2D.

Gate lock 18 is configured to lock gate 16 to gate mount 14 as shown in FIG. 1. Gate lock 18 includes a latch actuator 40 comprising an outer casing that is defined by slidable retractor release 402 and an inner casing that is defined by pivotable latch retractor 302 and a slidable latch 22 comprising a bolt head 221H as shown in FIG. 2. The inner and outer casings 302, 402 are sized and shaped to fit around a top rail 16T of gate 16. The inner and outer casings 302, 402 are pivotable about a retractor-pivot axis 302A from a locked configuration in which the inner and outer casings 30, 40 lie in generally parallel relation to top rail 16 as shown in FIGS. 2 and 4 and an unlocked configuration in which the inner and outer casings 302, 402 pivot upwardly together away from top rail 16T to lie in an angled relation to top rail 16T as shown in FIG. 9. Gate lock 18 is configured to block pivoting movement of gate 16 relative to gate mount 14 when gate lock 18 is in the locked configuration and allow movement of gate 16 relative to gate mount 14 when gate lock 18 is in the unlocked configuration.

Outer casing 402 is formed to include a 7-shaped pin-receiver slot 402S that receives a latch-retractor pin 24 as shown in FIGS. 4, 6, 7, and 9. The 7-shaped pin-receiver slot 402S is defined by a horizontal slot segment 402SH and positively sloping angled slot segment 402SA. The horizontal slot segment is 402SH generally parallel to top rail 16T when gate lock 18 is in the locked configuration. The angled slot segment 402SA extends at an angle downwardly from horizontal slot segment 402SH. Inner casing 30 is formed to include a slanted slot 302S that is aligned with angled slot segment 402SA of 7-shaped pin-receiver slot 402S in outer casing 40. Latch-retractor pin 24 extends through inner casing 302 and engages a slidable shuttle 222 included in the slidable latch 22.

A cover 404 may be coupled to outer casing 402 to block access to the 7-shaped pin-receiver slot 402S as suggested in FIG. 3. A cover 406 can be mounted on the opposite side of outer casing 402 as suggested in FIG. 3.

Outer casing 402 is configured to translate or slide relative to top rail 16T and inner casing 302 from a FORWARD PIVOT-BLOCKING position (slid to the right) as shown in FIG. 4 to a REARWARD RETRACTOR-RELEASING position (slid to the left) as shown in FIG. 7. Latch-retractor pin 24 blocks pivotable movement of inner and outer casings 302, 402 relative to top rail 16T of gate 16 about retractor-pivot axis 302A when outer casing 402 is in the restricted position. Inner and outer casings 302, 402 are free to pivot relative to top rail 16T of gate 16 about retractor-pivot axis 302A when outer casing 402 is in the REARWARD RETRACTOR-RELEASING position as shown in FIG. 7. Latch-retractor pin 24 is guided through the positively sloping angled slot segment 402SA of the 7-shaped bolt-receiver slot 402S and the corresponding slanted slot 302S in inner casing 302 as the inner and outer casings 302, 402 pivot upwardly from the LOWERED position about retractor-pivot axis 302A to a PIVOTED position as shown in FIG. 9.

Gate unit 10 is placed in a doorway as shown in FIG. 1A. Gate unit 10 includes a U-shaped gate mount 14 mating with a door frame 13 bordering a doorway 12, a gate 16 mounted on gate mount 14 for swinging movement about a vertical gate-pivot axis 16A between CLOSED and OPENED positions, and a gate lock 18 coupled to gate 16. Gate lock 16 is configured to mate with a right-side portion 14R of gate mount 14 to lock gate 16 so as to retain gate 16 in the CLOSED position. Gate lock 16 is configured and to be actuated by an operator using a two-step SLIDE-BACK/LIFT-UP process in accordance with the present disclosure as suggested in FIGS. 1B and 2B and as shown in FIGS. 4, 7, and 9 to unlock gate 16 so that it can be pivoted from the CLOSED position to an OPENED position as shown in FIG. 2D.

Figure 2A:
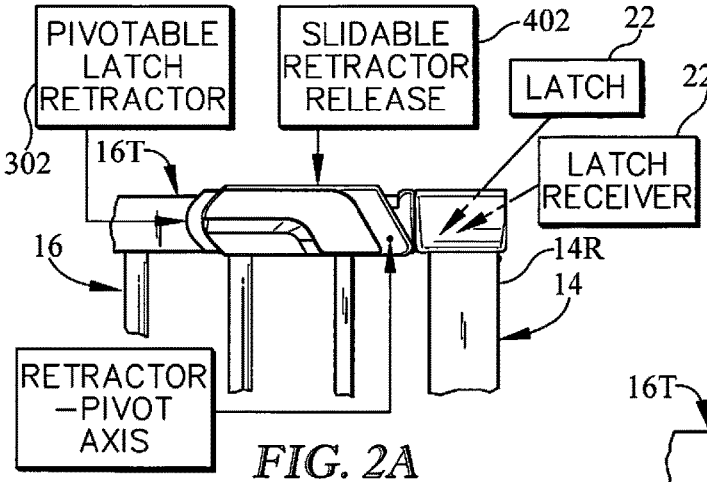
FIG. 2A is an enlarged side elevation view of the circled region in FIG. 1 suggesting that the latch extends beyond a free end of a top rail of the gate into a latch receiver formed in the gate mount to block pivotable movement of the gate about the gate-pivot axis and suggesting that the pivotable latch retractor is mounted on the top rail of the gate to be pivoted about the retractor pivot axis and that the slidable retractor release is mounted to slide on the pivotable latch retractor.
Figure 2B:
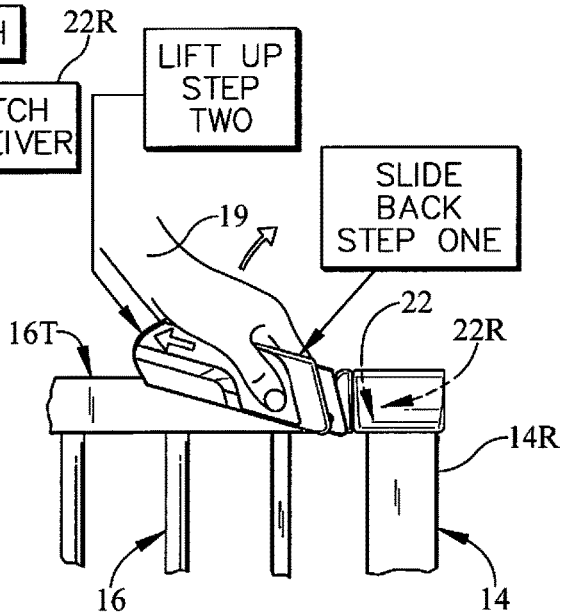
FIG. 2B is a view similar to FIG. 2A showing slide-back of the slidable retractor release on the pivotable latch retractor in a first SLIDE-BACK step to free the pivotable latch retractor to be pivoted upwardly in a second LIFT-UP step to retract the latch from the latch receiver formed in the gate mount.

Gate lock 16 includes a gate-pivot blocker 20 comprising a slidable latch 22 mounted for back-and-forth sliding movement in a top rail 16T of gate 16 between an EXTENDED position extending beyond a free end of top rail 16T to block pivotable movement of gate 16 about the gate-pivot axis 16A as suggested in FIG. 2A and a RETRACTED position lying inside the free end of top rail 16T as suggested in FIGS. 2B and 10 to free gate 16 to be pivoted from the CLOSED position to the OPENED position. Gate lock 18 also includes a latch actuator 34 that is used by a gate operator in accordance with a two-step gate-unlocking SLIDE-BACK/LIFT UP process disclosed herein to unlock gate 16 as suggested in FIGS. 2A-2D and shown in FIGS. 4, 7, and 9.

Gate lock 18 further includes a latch actuator 34 comprising a blocker-mover anchor 40 that is moved by a gate operator in a first SLIDE-BACK step to free a blocker mover 30 that will be pivoted by the gate operator 19 in a subsequent second LIFT-UP step to move gate-pivot blocker 20 to disengage gate mount 14 so that gate 16 is unlocked and free to pivot from the CLOSED position to an OPENED position. A pivotable latch retractor 302 included in blocker mover 30 is mounted on top rail 16T of gate 16 for pivotable movement about a horizontal retractor-pivot axis 302A during a LIFT-UP step from an INACTIVE position in which the slidable latch 22 is retained in its EXTENDED position shown in FIGS. 1A, 2A, and 4 to a PIVOTED LATCH-RETRACTING position shown in FIGS. 2A and 9 to cause the slidable latch 22 of gate-pivot blocker 20 to be moved relative to top rail 16T of gate 16 to its RETRACTED position. A slidable retractor release 402 also included in blocker-mover anchor 40 can slide back and forth on the pivotable latch retractor 302 under the control of a gate operator 19 to govern the pivot function of the pivotable latch retractor 302.

As suggested in FIG. 2A, latch 22 extends beyond a free end of top rail 16T of gate 16 into a latch receiver 22R formed in gate mount 14 to block pivotable movement of gate 16 about gate-pivot axis 16A. The pivotable latch retractor 302 is mounted on top rail 16T of gate 16 to be pivoted about the retractor-pivot axis 302. The slidable retractor release 402 is mounted to slide on the pivotable latch retractor 302. Slide-back of the slidable retractor release 402 on the pivotable latch retractor 302 in a first SLIDE-BACK step is shown in FIG. 2B to free the pivotable latch retractor 302 to be pivoted upwardly in a subsequent second LIFT-UP step to retract latch 22 from latch receiver 22R formed in gate mount 14.

Figure 2C:
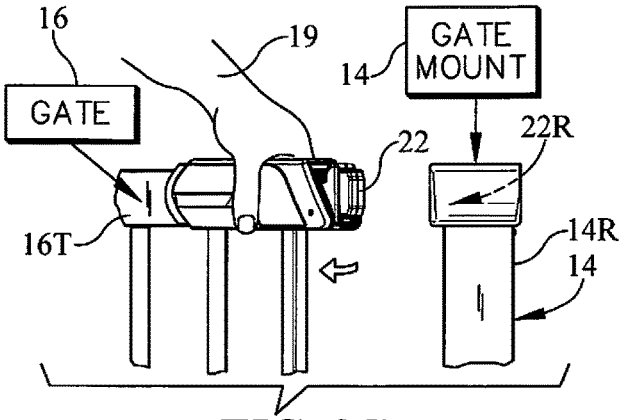
FIG. 2C is a view similar to FIGS. 2A and 2B showing that the gate lock has been unlocked and showing pivoting movement of the gate toward on OPENED position.
Figure 2D:
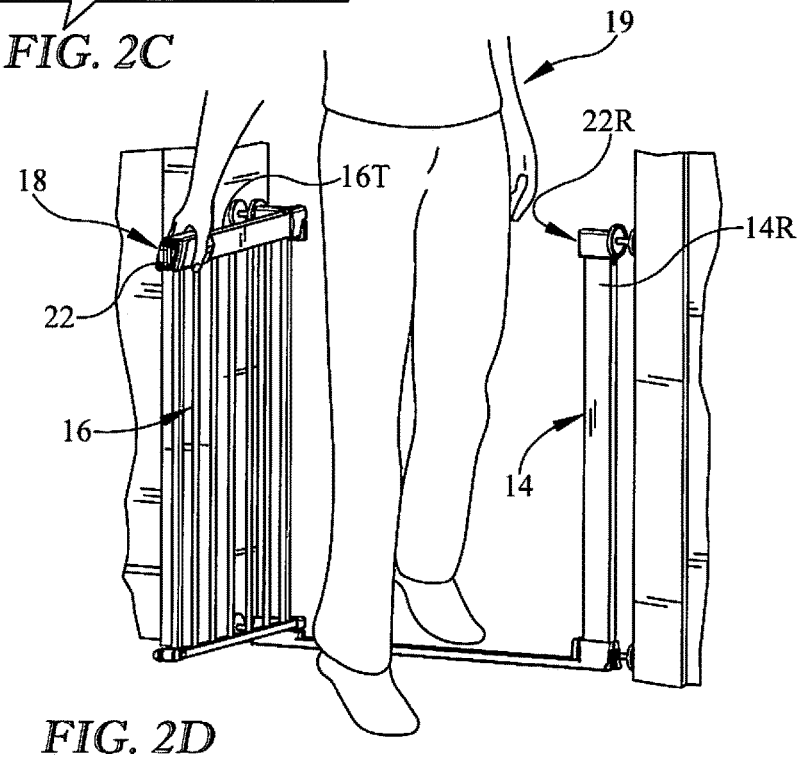
FIG. 2D is a perspective view similar to FIG. 1A showing the gate in the opened position.

As suggested in FIG. 2C, gate lock 18 has been unlocked and gate 16 has been pivoted toward on OPENED position. Gate 18 is shown in the opened position in FIG. 2D.

Gate-pivot blocker 20 includes a latch 22 and a latch-retractor pin 24 as suggested in FIG. 3. Latch 22 comprises a slidable shuttle 222 coupled to latch-retractor pin 24 and adapted to slide back and forth in a shuttle-receiver channel 222C formed in top rail 16T of gate 16. A lock bolt 221 included in latch 22 is sized to extend into a latch receiver 22R formed in gate mount 14 when gate 16 occupies the CLOSED position. A bolt-biasing spring 223 also included in latch 22 is provided for acting between the slidable shuttle 222 and lock bolt 221 to yieldably urge lock bolt 221 away from the slidable shuttle 222 to assure the EXTENDED position yet allow relative movement between lock bolt 221 and the slidable shuttle 222 during latching of gate 16.

The slidable latch 22 is shown in FIG. 4 in the EXTENDED position to cause lock bolt 221 to extend outwardly beyond the free end of top rail 16*t* of gate 16. Latch actuator 34 is shown in a STAGE-ONE INACTIVE position in which a slidable retractor release 402 included in blocker-mover anchor 40 is spring-biased by a spring 306 interposed between the pivotable latch retractor and the slidable retractor 302 release 402 as suggested in FIG. 5 to move relative to the pivotable latch retractor 302 of blocker mover 30 that is coupled for pivotable movement about retractor-pivot axis 302A relative to top rail 16T a FORWARD PIVOT-BLOCKING position.

The slidable retractor release 402 of blocker-mover anchor 40 is formed to include a 7-shaped pin-receiver slot 402S comprising a horizontal slot segment 402SH and a positively sloping angled slot segment 402S communicating with a right end of the horizontal slot segment 402SH at a segment junction 402SJ between the slot segments 402SH, 402SJ. The pivotable latch retractor 302 is formed to include a positively sloping slanted slot 302S (shown in phantom) that is not aligned with the positively sloping angled slot segment 402SA of the 7-shaped pin-receiver slot 402S of the slidable retractor release 402. A side elevation view is provided in FIG. 6 to show that clockwise pivoting motion of the pivotable latch retractor 302 about the retractor-pivot axis 302A (to cause retraction of latch 22) is blocked by engagement of latch-retractor pin 24 included in the slidable gate-pivot blocker 20 and a side edge of slot 402S included in the slidable retractor release 402 of blocker-mover anchor 40.

The pivotable latch retractor 302 of latch actuator 34 is mounted to top rail 16T of the gate 16 for pivotable movement about retractor-pivot axis 302A. As shown in FIG. 5, the slidable latch 22 comprises a lock bolt 221 including a forwardly extending bolt head 221H and a rearwardly extending bolt tail 221T, a slidable shuttle 222 mounted for back-and-forth sliding movement relative to top rail 16T in a shuttle-receiver channel 222C formed in top rail 16T between a BOLT-EXTENDED position shown in FIGS. 4-8 and a BOLT-RETRACTED position shown in FIGS. 9 and 10, and a compressible bolt-biasing spring 223 acting between and against the slidable shuttle 222 and bolt head 221H of lock bolt 221 and winding around bolt tail 221T of lock bolt 221. Latch-retractor pin 24 is coupled to the slidable shuttle 222 to move therewith and arranged to extend outwardly away from the slidable shuttle 222 into a straight pin-receiver channel 22C formed in bolt tail 221T of lock bolt 221 and into the 7-shaped bolt-receiver slot 402S formed in the slidable retractor release 402 of blocker-mover anchor 40 of latch actuator 34.

Latch actuator 34 is shown in a STAGE-TWO INACTIVE position in which the slidable retractor release 402 of blocker-mover anchor 40 has been moved to the left away from the free end of top rail 16T of gate 16 to compress a spring 306 interposed between the pivotable latch retractor 302 and the slidable retractor release 402 and to cause relative movement between the slidable retractor release 402 of latch actuator 34 and the slidable shuttle 222 of latch 22 to cause latch-retractor pin 24 to move in the 7-shaped pin-receiver slot 402S to a junction 402SH provided at the right end of the horizontal slot segment 402SH between the horizontal slot segment 402SH and the positively sloping angled slot segment 402SA so that latch-retractor pin 24 is now poised to enter and move downwardly in the positively sloping angled slot segment 402SA as shown in FIG. 9. The slidable retractor release 402 is shown in a REARWARD position on the pivotable latch retractor 302 when latch actuator 34 is in the STAGE-TWO INACTIVE position as shown in FIGS. 7 and 8.

As suggested in FIG. 9, the pivotable latch retractor 302 has been pivoted in a clockwise direction about retractor-pivot axis 302A to an UPWARDLY PIVOTED position from a LOWERED position shown in FIGS. 4 and 7 because latch-retractor pin 24 coupled to the slidable shuttle 222 was free to move in both of the positively sloping angled slot segment 402SA of the 7-shaped pin-receiver slot 402S to a bottom end of the positively sloping angled slot segment 402SA and the aligned positively sloping slanted slot 302S formed in the pivotable latch retractor 302. The pivotable latch retractor 302 is shown in the PIVOTED LATCH-RETRACTING position in FIG. 10. The slidable retractor release 402 has applied a rearwardly directed force to latch-retractor pin 24 to cause the slidable shuttle 222 to move rearwardly in top rail 16T of gate 16 from the FORWARD PIVOT-BLOCKING position shown in FIGS. 5 and 8 to the REARWARD RETRACTOR-RELEASING position shown in FIG. 10 to cause the slidable latch 22 to move relative to top rail 16T of gate 16 from the EXTENDED POSITION shown in FIGS. 5 and 8 to the RETRACTED position shown in FIG. 10.

A process is disclosed and illustrated herein for withdrawing a latch 22 mounted for sliding movement on a gate 16 toward gate-pivot axis 16A associated with gate 16 to disengage a latch receiver 22R included in a gate mount 14 that is adapted to mate with a frame 13 bordering a passageway 12. Gate mount 14 is formed to include a walkway passage through which a person may walk and is used to support gate 16 for pivotable movement about gate-pivot axis 16A between a closed position closing the walkway position formed in gate mount 14 to block movement of a person through the walkway passage and an opened position opening the walkway passage.

The process comprises the step of mounting a pivotable latch retractor 302 on a top rail 16T of gate 16 to engage a latch-retractor pin 24 that is coupled to latch 22 to slide with latch 22 relative to top rail 16T of gate 16 as latch 22 slides from an EXTENDED position engaging latch receiver 22R formed in gate mount 14 to a RETRACTED position disengaging latch receiver 22R formed in gate mount 14 and to pivot on top rail 16T about a retractor-pivot axis 302A between a LOWERED position lying alongside top rail 16T of gate 16 and a PIVOTED position lying at an angle to top rail 16T of gate 16. The process also includes the step of locating a slidable retractor release 402 on the pivotable latch retractor 302 normally to engage latch-retractor pin 24 to block pivotable movement of the pivotable latch retractor 302 about retractor-pivot axis 302A while the slidable retractor release 402 remains in a FORWARD position lying at a first distance from gate-pivot axis 16 and the latch 22 remains in the EXTENDED position engaging the latch receiver 22R formed in gate mount 14 to block pivoting movement of gate 16 about gate-pivot axis 16A.

The process further comprises the step of sliding the slidable retractor release 402 on the pivotable latch retractor 302 from the FORWARD position in a direction toward gate-pivot axis 16A to a REARWARD SLIDE-BACK position lying at a relatively smaller second distance from gate-pivot axis 16A to disengage the pivotable latch retractor 302 from latch-retractor pin 24 to release the pivotable latch retractor 302 so that the pivotable latch retractor 302 is free to pivot upwardly about retractor-pivot axis 302A from the LOWERED position to the PIVOTED position.

The process also comprises the step of pivoting the pivotable latch retractor 302 upwardly about retractor-pivot axis 302A from the LOWERED position to the PIVOTED position while the slidable retractor release 402 remains in the REARWARD SLIDE-BACK position on the pivotable latch retractor 302 to apply a retraction force to latch-retractor pin 24 to cause latch 22 to move relative to gate 16 and gate mount 14 from the EXTENDED position engaging the latch receiver 22R formed in gate mount 14 to the RETRACTED position disengaging the latch receiver 22R formed in gate mount 14 to free gate 16 to be pivoted about gate-pivot axis 16A from the CLOSED position to the OPENED position to allow movement of a person through the walkway passage formed in gate mount 14.

The pivotable latch retractor 302 includes pin-guide means 302R for moving latch-retractor pin 24 away from the latch receiver 22R formed in gate mount 14 in a direction toward gate-pivot axis 16A. This movement of latch-retractor pin 24 causes latch 22 to move from the EXTENDED position to the RETRACTED position in response to upward pivoting movement of the pivotable latch retractor 302 relative to top rail 16T about retractor-pivot axis 302A.

The pivotable latch retractor 302 includes a retractor top wall 302T lying above the top rail 16T of the gate 16 and a retractor side wall 302W depending from the top wall 302T to lie alongside a vertical side wall 16TW of top rail 16T. The pin-guide means 302S is provided by a positively sloping slanted slot 302S formed in the retractor side wall 302W to receive latch-retractor pin 24 for back-and-forth sliding movement therein along a positively sloping path.

The slidable retractor release 402 includes a release side wall 402W arranged to lie in laterally spaced-apart relation to the vertical side rail 16TW of top rail 16T of gate 16 to locate the retractor side wall 302W therebetween. The release side wall 302W is formed to include a 7-shaped pin-receiver slot 402S comprising a horizontal slot segment 402SH and a positively sloping angled slot 402SA segment communicating with a right end of the horizontal slot segment 402SH at a segment junction 402SJ between the horizontal and angled slot segments 402SH, 402SA and aligning in side-by-side parallel relative to one another with the positively sloping slanted slot 302S formed in the retractor side wall 302W only when the slidable retractor release 402 occupies the REARWARD SLIDE-BACK position on the pivotable latch retractor 302.

Figure 6:
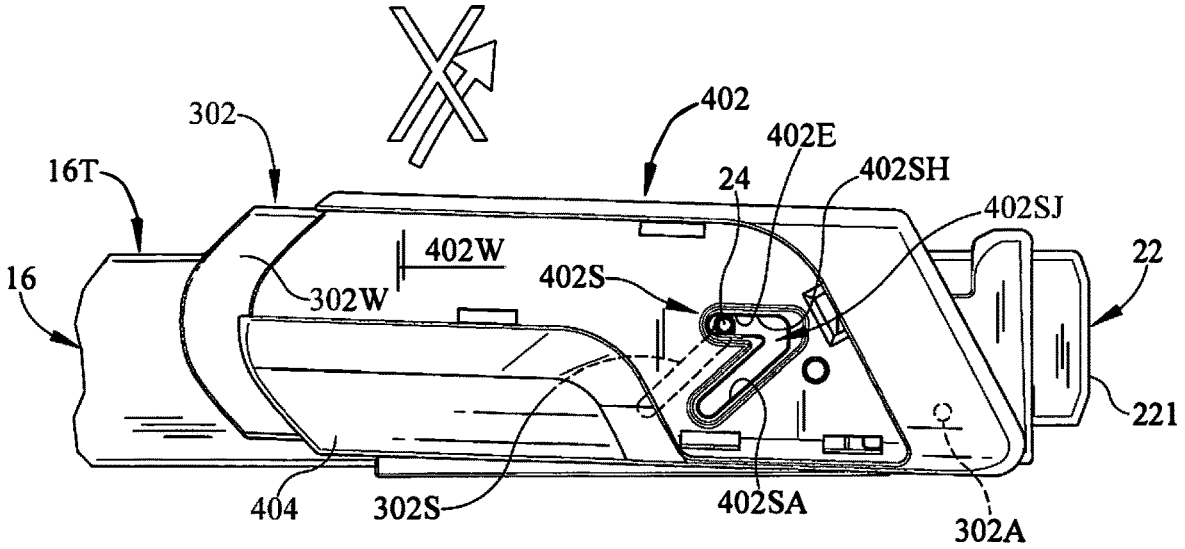
FIG. 6 is a side elevation view similar to FIG. 4 showing that clockwise pivoting motion of the pivotable latch retractor about the retractor-pivot axis (to cause retraction of latch)

Latch-retractor pin 24 is arranged to lie in the horizontal slot segment 402SH formed in the slidable retractor release 402 when the slidable retractor release 402 occupies the FORWARD position on the pivotable latch retractor 302 to engage a segment edge 402E included in the slidable retractor release 402 as shown in FIG. 6 to block pivotable movement of the pivotable latch retractor 302 from the LOWERED position to the PIVOTED position. Latch-retractor pin 24 is arranged to lie in the positively sloping angled slot segment 402SH formed in the slidable retractor release 402 following sliding movement of the slidable retractor release 402 on the pivotable latch retractor 302 from the FORWARD position to the REARWARD position to free latch-retractor pin 24 to move in each of the positively sloping angled and slanted slots 402SA, 302S simultaneously as suggested in FIGS. 7 and 9 and thereby allow pivoting movement of the pivotable latch retractor 302 from the LOWERED position to the PIVOTED position to cause latch 22 to move from the EXTENDED position to the RETRACTED position.

Figure 11:
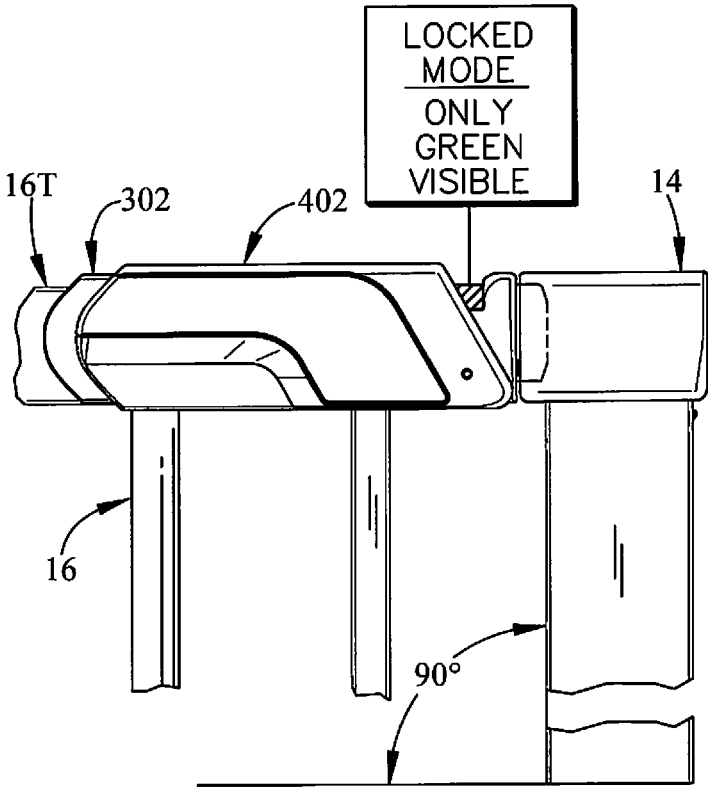

The gate lock 18 further includes an indicator 221R1, 221G, 221R2 configured to tell a caregiver when gate unit 10 is used and installed properly in a doorway 12 as suggested in FIGS. 11-14. The indicator is positioned on lock bolt 221 and is visible to the caregiver through a window formed in lock-bolt mount. The indicator includes a green indicator 221G and two red indicators 221R1, 221R2 spaced apart from one another on each side of the green indicator 221G as suggested in FIG. 3. When a caregiver correctly installs the gate 16 unit in a doorway 12, only the green indicator 221G will be visible to the caregiver through the window as shown in FIG. 11. However, if the gate 16 unit is installed incorrectly, one of the red indicators 221R1, 221R2 will be visible to the caregiver to indicate that further adjustment of the gate unit 10 is needed.

Figure 13:
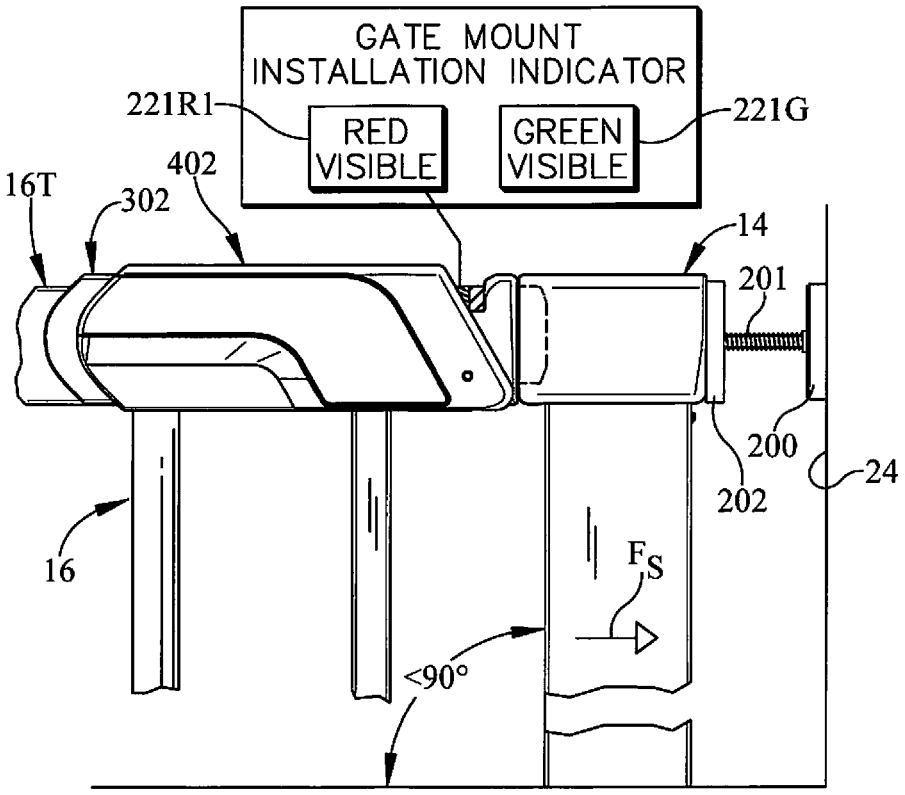
Figure 14:
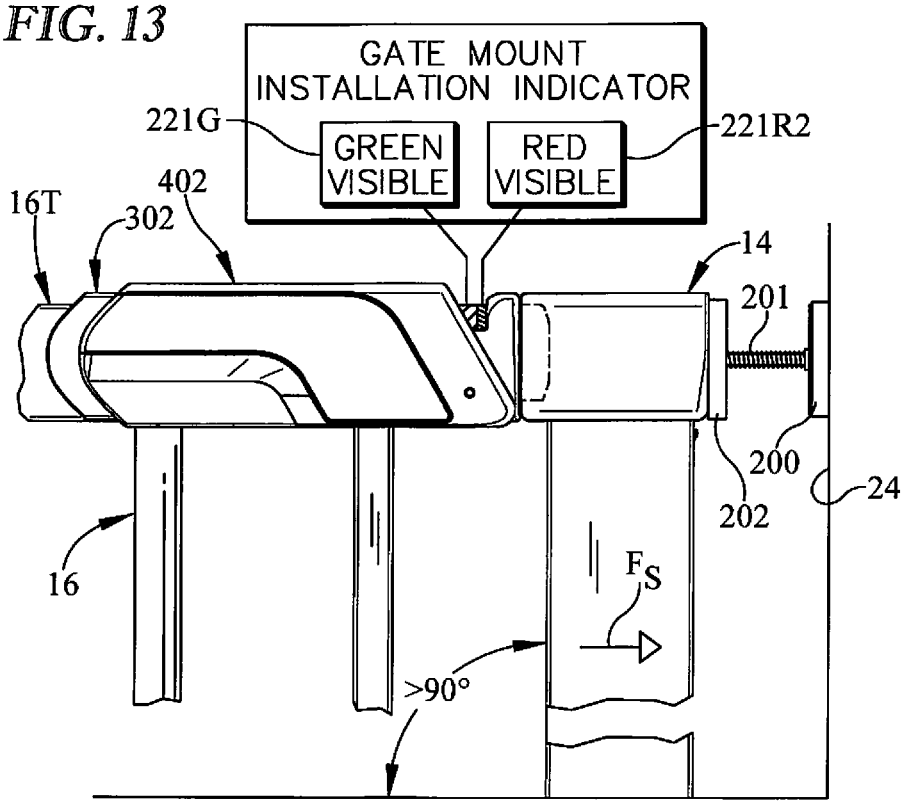

The position of gate mount 14 and gate 16 relative to doorjamb 13 of the doorway 12 determines which indicator or indicators are visible to the caregiver. Gate mount 14 is configured to cause right leg 14R shown in FIG. 1 to be sprung outwardly by internal spring face Fs. During installation, a gate installer rotates disk 202 on screw 201 to move toward or away from wall-mount disk 202. For example, if vertical leg 14R gate mount 14 is angled inwardly as suggested in FIG. 13, lock bolt 221 will be compressed by gate mount 14 and the left red indicator 221R1 will be visible in the window as shown in FIG. 13. Conversely, if gate mount 14 is angled outwardly towards doorjamb 24 as suggested in FIG. 14, the biasing spring pushes the lock bolt 221 outward toward the doorjamb 24 and the right red indicator 221R2 is visible in the window as shown in FIG. 14.

Figure 12:
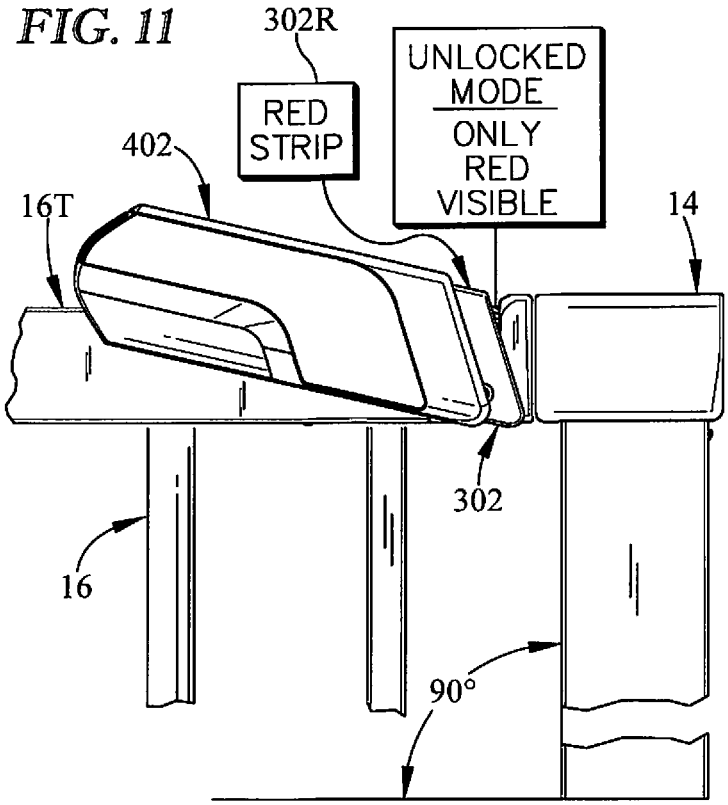

Once gate mount 14 is set up properly as suggested in FIGS. 11 and 12, only green indicator 221G will be visible when gate lock 18 is locked. In the unlocked mode of gate lock 18 shown in FIG. 12 only red will be visible in the window and movement of slidable retractor release 402 to the left will expose a red strip 302R provided on a right end edge of the top wall 302T of pivotable latch retractor 302 as shown in FIGS. 3 and 12.

In illustrative embodiments, gate lock 18 includes a slidable latch 22 and a latch-retractor pin 24 coupled to the slidable latch 22 to move therewith. The slidable latch 22 is mounted for back-and-forth horizontal movement along a horizontally extending top rail 16T of gate 16 between EXTENDED and RETRACTED positions. In the EXTENDED position, the slidable latch 22 extends beyond end of top rail 16T and engages the latch receiver 24R provided in gate mount 14 when gate 16 occupies the CLOSED position so as to lock gate 16 and block pivoting movement of gate 16 about gate-pivot axis 16A. In the RETRACTED position, the slidable latch 22 is drawn into a hollow region provided in top rail 16T to disengage the latch receiver 22R provided in gate mount 14 so as to unlock gate 16 and free gate 16 to be pivoted about gate-pivot axis 16A to the OPENED position.

Gate lock 18 also includes a pivotable inner casing 302 mounted for pivotable movement relative to top rail 16T of gate 16 about a casing-pivot axis 302A. Latch-retractor pin 24 is arranged to extend outwardly into an angled slot 302A formed in the pivotable inner casing 302 so as to lie in an upper end zone in the angled slot 302A when the pivotable inner casing 302 lies in a horizontal orientation to extend along top rail 16T of gate 16 as suggested in FIG. 6.

A user can pivot the pivotable inner casing 302 about the casing-pivot axis 302A to cause an outer end of the pivotable inner casing 302 to move upwardly away from top rail 16 as suggested in FIG. 9 and such movement will cause latch-retractor pin 24 to move in the angled slot 302S toward a lower end zone in the angled slot 302S so that latch-retractor pin 24 is moved horizontally relative to top rail 16T and away from the latch receiver 22R formed in gate mount 14 when gate 16 is in the CLOSED position. Such inward motion of latch-retractor pin 24 causes the slidable latch 22 to move inwardly relative to top rail 16T so as to disengage the latch receiver 22R formed in gate mount 14 so that gate 16 is free to be pivoted about the gate-pivot axis 16A from the CLOSED position to the OPENED position.

Gate lock 18 also includes a releasable inner-casing pivot blocker 40 that is configured to provide means for blocking pivotable movement of the pivotable inner casing 302 about the casing-pivot axis 302A until released by a lock operator 19. The releasable inner-casing pivot blocker includes a movable outer casing 402 that is wrapped around the pivotable inner casing 302 and mounted for back-and-forth horizontal sliding movement relative to the pivotable inner casing 302 and a casing-biasing spring 306 that is interposed between the inner and outer casings 302, 402. The movable outer casing 402 is mounted for sliding movement on the inner casing 302 between FORWARD and REARWARD positions. The casing-biasing spring 306 is arranged to yieldably urge the movable outer casing 402 normally toward the outer end of the rail 16T to assume the FORWARD position.

Latch-retractor pin 24 is also arranged to extend into a 7-shaped pin-receiver slot 402S that is formed in the movable outer casing 402. The 7-shaped pin-receiver slot 402S includes a horizontal segment 402SH and an angled slot segment 402SA that connect at a segment junction 402ST. When the latch-retractor pin 24 lies in the horizontal segment 402SH, pivotable movement of the inner casing 302 about the casing-pivot axis 302A is blocked. However, when the latch-retractor pin 24 lies in the angled slot segment 402SH, pivotable movement of the inner casing 302 about the casing-pivot axis 302A is possible because the angled slot 302S formed in the inner casing 30 and the angled slot segment 402SA formed in the surrounding outer casing 402 are aligned in spaced-apart parallel relative to one another.

The slidable latch 22 further includes a slidable shuttle 222 and a bolt-biasing spring 223 acting between the slidable shuttle 222 and the lock bolt 221 normally to move the lock bolt 221 to the EXTENDED position. The latch-retractor pin 24 is coupled to the slidable shuttle 22 to move back and forth with the slidable shuttle 222 relative to the inner and outer casings 302, 402 during pivotable movement of the inner and outer casings 302, 402 relative to top rail 16T about the casing-pivot axis 302A.

In illustrative embodiments, in a first gate-unlocking step, the operator slides the outer casing 402 back on the inner casing 302 to the REARWARD position to compress the casing-biasing spring 306 provided between the inner and outer casings 302, 402 and to cause latch-retractor pin 24 to move in the horizontal slot segment 402SH to the segment junction 402ST between the horizontal and angled slot segments 402SH, 402SA In a subsequent second gate-unlocking step, the operator pivots the inner and outer casings 302, 402 of the latch retractor 34 about the casing-pivot axis 302A while latch-retractor pin 24 travels in the angled slot segment 402SA of the 7-shaped pin receiver 402S formed in the outer casing 402 and from the top end zone to the bottom end zone of the angled slot 302S formed in the inner casing 302 from the segment junction 402ST to a bottom end of the angled slot segment 402SA. Such travel also causes rearward lateral movement of latch-retractor pin 24 away from the latch receiver 22R formed in gate mount 14 and lateral movement of the slidable latch 22 from the EXTENDED position extending into the latch receiver 22R to the RETRACTED position disengaging the latch receiver 22R. At this point, gate 16 is unlocked and free to be pivoted about gate-pivot axis 16A from the CLOSED position to the OPENED position.

The invention claimed is:

1. A process for withdrawing a latch mounted for sliding movement on a gate toward a gate-pivot axis associated with the gate to disengage a latch receiver included in a gate mount that is adapted to mate with a frame bordering a passageway, formed to include a walkway passage through which a person may walk, and used to support the gate for pivotable movement about the gate-pivot axis between a closed position closing the walkway position formed in the gate mount to block movement of a person through the walkway passage and an opened position opening the walkway passage, the process comprising the steps of mounting a pivotable latch retractor on a top rail of the gate to engage a latch-retractor pin that is coupled to the latch to slide with the latch relative to the top rail of the gate as the latch slides from an extended position engaging the latch receiver formed in the gate mount to a retracted position disengaging the latch receiver formed in the gate mount and to pivot on the top rail about a retractor-pivot axis between a lowered position lying alongside the top rail of the gate and a pivoted position lying at an angle to the top rail of the gate, locating a slidable retractor release on the pivotable latch retractor to engage the latch-retractor pin to block pivotable movement of the pivotable latch retractor about the retractor-pivot axis while the slidable retractor release remains in a forward position lying at a first distance from the gate-pivot axis and the latch remains in the extended position engaging the latch receiver formed in the gate mount to block pivoting movement of the gate about the gate-pivot axis, sliding the slidable retractor release on the pivotable latch retractor from the forward position in a direction toward the gate-pivot axis to a rearward slide-back position lying at a relatively smaller second distance from the gate-pivot axis to disengage the pivotable latch retractor from the latch-retractor pin to release the pivotable latch retractor so that the pivotable latch retractor is free to pivot upwardly about the retractor-pivot axis from the lowered position to the pivoted position, and pivoting the pivotable latch retractor upwardly about the retractor-pivot axis from the lowered position to the pivoted position while the slidable retractor release remains in the rearward slide-back position on the pivotable latch retractor to apply a retraction force to the latch-retractor pin to cause the latch to move relative to the gate and the gate mount from the extended position engaging the latch receiver formed in the gate mount to the retracted position disengaging the latch receiver formed in the gate mount to free the gate to be pivoted about the gate-pivot axis from the closed position to the opened position to allow movement of a person through the walkway passage formed in the gate mount.

2. The process of claim 1, wherein the pivotable latch retractor includes first pin-guide means for moving the latch-retractor pin away from the latch receiver formed in the gate mount in a direction toward the gate-pivot axis to cause the latch to move from the extended position to the retracted position in response to upward pivoting movement of the pivotable latch retractor relative to the top rail about the retractor-pivot axis.

3. The process of claim 2, wherein the pivotable latch retractor includes a retractor top wall lying above the top rail of the gate and a retractor side wall depending from the top wall to lie alongside a vertical side wall of the top rail and the first pin-guide means is provided by a positively sloping slanted slot formed in the retractor side wall to receive the latch-retractor pin for back-and-forth sliding movement therein along a positively sloping path.

4. The process of claim 3, wherein the slidable retractor release includes a release side wall arranged to lie in laterally spaced-apart relation to the vertical side rail of the top rail of the gate to locate the retractor side wall therebetween, the release side wall is formed to include a 7-shaped pin-receiver slot comprising a horizontal slot segment and a positively sloping angled slot segment communicating with a right end of the horizontal slot segment at a segment junction between the horizontal and angled slot segment and aligning in side-by-side parallel relative to one another with the positively sloping slanted slot formed in the retractor side wall only when the slidable retractor release occupies the rearward slide-back position on the pivotable latch retractor, the latch-retractor pin is arranged to lie in the horizontal slot segment formed in the slidable retractor release when the slidable retractor release occupies the forward position on the pivotable latch retractor to engage a segment edge included in the slidable retractor release to block pivotable movement of the pivotable latch retractor from the lowered position to the pivoted position, and the latch-retractor pin is arranged to lie in the positively sloping angled slot segment formed in the slidable retractor release following sliding movement of the slidable retractor release on the pivotable latch retractor from the forward position to the rearward position to free the latch-retractor pin to move in each of the positively sloping angled and slanted slots simultaneously and thereby allow pivoting movement of the pivotable latch retractor from the lowered position to the pivoted position to cause the latch to move from the extended position to the retracted position.

5. The process of claim 2, wherein the locating step further includes the step of interposing a release-biasing spring between the pivotable latch retractor and the slidable retractor release to yieldably urge the slidable retractor release to assume the forward position until the slidable retractor release is moved relative to the pivotable latch retractor toward the rearward slide-back position.

6. The process of claim 5, wherein the spring is a coiled compression spring arranged to lie between the latch and the slidable retractor release, one end of the coiled compression spring is arranged to engage a spring-engagement surface of the pivotable latch retractor, and an opposite end of the coiled compression spring is arranged to engage a flange included in the slidable retractor release and movement of the slidable retractor release from the forward position toward the rearward slide-back position causes the flange to move toward the spring-engagement surface of the pivotable latch retractor to compress the coiled compression spring.

7. The process of claim 6, wherein the latch includes a slidable shuttle mounted for sliding movement in the top rail of the gate, a lock bolt arranged to extend beyond an end of the top rail of the gate to engage the latch receiver when the latch occupies the extended position and arranged to lie within the top rail of the gate to disengage the latch receiver when the latch occupies the retracted position, and a bolt-biasing spring acting between the slidable shuttle and the lock bolt normally to extend the lock bolt into the latch receiver when the gate is in the closed position, and wherein the latch-retractor pin is coupled to the slidable shuttle to move therewith.

8. The process of claim 1, wherein the pivotable latch retractor is formed to include a slanted pin-receiver slot, the slidable retractor release is formed to include a 7-shaped pin-receiver slot comprising a horizontal slot segment and a positively sloping angled slot segment communicating with a right end of the horizontal slot segment at a segment junction between the horizontal and angled slot segments, the latch-retractor pin is arranged to extend through the slanted pin-receiver slot formed in the pivotable latch retractor and the horizontal slot segment of the 7-shaped pin-receiver slot formed in the slidable retractor release when the latch is in the extended position, and the latch-retractor pin is arranged to extend through the slanted pin-receiver slot formed in the pivotable latch retractor and the positively sloping angled slot segment of the 7-shaped pin-receiver slot formed in the slidable retractor release when the latch is in the retracted position.

9. The process of claim 8, wherein the pivotable latch retractor includes a retractor top wall lying above the top rail of the gate and a retractor side wall depending from the retractor top wall to lie alongside a vertical side wall of the top rail, the retractor side wall is formed to include the slanted pin-receiver slot, the latch-retractor pin lies in an upper end of the slanted pin-receiver slot to lie a first distance from the retractor top wall when the latch is in the extended position, and the latch-retractor pin lies in an opposite lower end of the slanted pin-receiver slot to lie a greater second distance from the retractor top wall when the latch is in the retracted position.

10. The process of claim 8, wherein the slanted pin-receiver slot formed in the pivotable latch retractor is arranged to lie in spaced-apart parallel relation to the positively sloping angled slot segment of the 7-shaped pin-receiver slot formed in the slidable retractor release to allow the latch-retractor pin to extend simultaneously through each of the slanted pin-receiver slot and the horizontal slot segment when the latch is in the extended position and the slanted pin-receiver slot formed in the pivotable latch retractor is arranged to lie in side-by-side coextensive relation to the positively sloping angled slot segment of the 7-shaped pin-receiver slot formed in the slidable retractor release to allow the latch-retractor pin to extend simultaneously through each of the slanted pin-receiver slot and the positively sloping angled slot segment when the latch is in the retracted position.

11. A gate unit comprising a gate mount that is adapted to mate with a frame bordering a passageway and formed to include a latch receiver, a gate mounted on the gate mount for pivotable movement about a gate-pivot axis between an opened position opening a walkway passage formed in the gate mount and a closed position closing the walkway passage formed in the gate mount, and a gate lock including a gate-pivot blocker comprising a slidable latch that is carried on the gate and arranged to slide relative to the gate to engage the latch receiver formed in the gate mount to lock the pivotable gate in the closed position and to disengage the latch receiver to free the gate to be pivoted about the gate-pivot axis to the opened position and a latch-retractor pin coupled to the slidable latch to slide therewith, the gate lock further including a latch actuator comprising a pivotable latch retractor that is mounted for pivotable movement on the gate about a retractor-pivot axis between a lowered position and a pivoted position and a slidable retractor release that is mounted for sliding movement on and relative to the pivotable latch retractor between a forward pivot-blocking position blocking pivotable movement of the pivotable latch retractor about the retractor-pivot axis and a rearward retractor-releasing position allowing pivotable movement of the pivotable latch retractor about the retractor-pivot axis to cause the slidable retractor release to be pivoted about the retractor-pivot axis during pivoting movement of the pivotable latch retractor about the retractor-pivot axis, and wherein the pivotable latch retractor includes pin-guide means for moving the latch-retractor pin relative to the gate to cause the slidable latch to move relative to the gate from an extended position engaging the latch receiver formed in the gate mount to a retracted position disengaging the latch receiver formed in the gate mount in response to upward pivoting movement of the pivotable latch retractor about the retractor-pivot axis from the lowered position to the pivoted position after the slidable retractor release has been moved on the pivotable latch retractor from the forward pivot-blocking position to the rearward retractor-releasing position, and the slidable retractor release is formed to include slot means for receiving a portion of the latch-retractor pin therein while the slidable retractor release occupies each of the forward pivot-blocking position and the rearward retractor-releasing position and during movement of the slidable retractor release relative to the pivotable latch retractor between the forward pivot-blocking position and the rearward retractor-releasing position so that pivoting movement of the pivotable latch retractor about the retractor-pivot axis is blocked when the pivotable latch retractor occupies the lowered position and the slidable retractor release occupies the forward pivot-blocking position on the pivotable latch retractor owing to engagement of the latch-retractor pin with an edge of each of the pivotable latch retractor and the slidable retractor release and so that pivoting movement of the pivotable latch retractor and the slidable retractor release is allowed owing to simultaneous movement of the latch-retractor pin in each of the pin-guide means formed in the pivotable latch retractor and the slot means formed in the slidable retractor means when the slidable retractor release occupies the rearward retractor-releasing position on the pivotable latch retractor.

12. The gate unit of claim 11, wherein the pin-guide means formed in the pivotable latch retractor is a slanted pin-receiver slot and the slot means formed in the slidable retractor release is a 7-shaped pin-receiver slot comprising a horizontal slot segment and a positively sloping angled slot segment communicating with a right end of the horizontal slot segment at a segment junction between the horizontal and angled slot segments, the latch-retractor pin is arranged to extend through the slanted pin-receiver slot formed in the pivotable latch retractor and the horizontal slot segment of the 7-shaped pin-receiver slot formed in the slidable retractor release when the slidable latch is in the extended position, and the latch-retractor pin is arranged to extend through the slanted pin-receiver slot formed in the pivotable latch retractor and the positively sloping angled slot segment of the 7-shaped pin-receiver slot formed in the slidable retractor release when the slidable latch is in the retracted position.

13. The gate unit of claim 12, wherein the gate further includes a top rail, the pivotable latch retractor is mounted on the top rail for pivotable movement about the retractor-pivot axis and wherein the pivotable latch retractor includes a retractor top wall lying above the top rail of the gate and a retractor side wall depending from the retractor top wall to lie alongside a vertical side wall of the top rail, the retractor side wall is formed to include the slanted pin-receiver slot, the latch-retractor pin lies in an upper end of the slanted pin-receiver slot to lie a first distance from the retractor top wall when the latch is in the extended position, and the latch-retractor pin lies in an opposite lower end of the slanted pin-receiver slot to lie a greater second distance from the retractor top wall when the latch is in the retracted position.

14. The gate unit of claim 13, where the slanted pin-receiver slot formed in the pivotable latch retractor is arranged to lie in spaced-apart parallel relation to the positively sloping angled slot segment of the 7-shaped pin-receiver slot formed in the slidable retractor release to allow the latch-retractor pin to extend simultaneously through each of the slanted pin-receiver slot and the horizontal slot segment when the latch is in the extended position and the slanted pin-receiver slot formed in the pivotable latch retractor is arranged to lie in side-by-side coextensive relation to the positively sloping angled slot segment of the 7-shaped pin-receiver slot formed in the slidable retractor release to allow the latch-retractor pin to extend simultaneously through each of the slanted pin-receiver slot and the positively sloping angled slot segment when the latch is in the retracted position.

15. The gate unit of claim 11, wherein the latch actuator further includes a release-biasing spring interposed between the pivotable latch retractor and the slidable retractor release and arranged to yieldably urge the slidable retractor release to assume the forward pivot-blocking position until the slidable retractor release is moved relative to the pivotable latch retractor toward the rearward slide-back position.

16. The gate unit of claim 15, wherein the spring is a coiled compression spring arranged to lie between the latch and the slidable retractor release, one end of the coiled compression spring is arranged to engage the pivotable latch retractor, and an opposite end of the coiled compression spring is arranged to engage a flange included in the slidable retractor release.

17. The process of claim 16, wherein the latch includes a slidable shuttle mounted for sliding movement in the top rail of the gate, a lock bolt arranged to extend beyond an end of the top rail of the gate to engage the latch receiver when the latch occupies the extended position and arranged to lie within the top rail of the gate to disengage the latch receiver when the latch occupies the retracted position, and a bolt-biasing spring acting between the slidable shuttle and the lock bolt normally to extend the lock bolt into the latch receiver when the gate is in the closed position, and wherein the latch-retractor pin is coupled to the slidable shuttle to move therewith.

* * * * *